US006317891B1

(12) United States Patent
Gafforio

(10) Patent No.: US 6,317,891 B1
(45) Date of Patent: Nov. 20, 2001

(54) COMBINED VENTILATION DEVICE FOR HELMETS FOR MOTORCYCLISTS

(75) Inventor: Luca Gafforio, Comun Nuovo (IT)

(73) Assignee: Opticos S.r.l., Brembate di Sopra (IT)

( * ) Notice: Subject to any disclaimer, the term of this patent is extended or adjusted under 35 U.S.C. 154(b) by 0 days.

(21) Appl. No.: 09/416,852

(22) Filed: Oct. 12, 1999

(30) Foreign Application Priority Data

May 27, 1999 (EP) ..... 99830324

(51) Int. Cl.[7] ..... A42B 3/28
(52) U.S. Cl. ..... 2/171.3; 2/410
(58) Field of Search ..... 2/410, 411, 422, 2/424, 425, 171.3

(56) References Cited

U.S. PATENT DOCUMENTS 4,704,746 * 11/1987 Nava ..... 2/424
4,731,885 * 3/1988 Nava ..... 2/424
5,093,938 * 3/1992 Kamata ..... 2/424
5,212,843 * 5/1993 Kamata ..... 2/424
5,388,278 * 2/1995 Taniuchi ..... 2/422
5,394,566 * 3/1995 Hong ..... 2/424

* cited by examiner

*Primary Examiner*—Michael A. Neas
(74) *Attorney, Agent, or Firm*—Collard & Roe, P.C.

(57) ABSTRACT

The invention relates to an internal ventilation device for helmets for motorcyclists. The ventilation system is integrated into the helmet body so that it is flush with the surface of the helmet cap. The ventilation system contains a front covering connected to back covering by a canalisation to form a duct with the internal surface of the cap. A sliding plate is transversely mounted between the front covering and the back covering and is capable of sliding within the duct. The front covering further comprises a central opening and two side openings each having a wing to open and close the opening. A system of levers and striker plates are provided on the sliding plate to allow opening and closing of the wings.

7 Claims, 7 Drawing Sheets

COMBINED VENTILATION DEVICE FOR HELMETS FOR MOTORCYCLISTS

BACKGROUND OF THE INVENTION

1. Field of the Invention

The present invention relates to a mechanical device of combined internal ventilation for protective helmets. More specifically, a ventilation system that is entirely hidden on the inside of the helmet cap, and therefore does not create discontinuities on the external surface of said cap.

2. The Prior Art

As is known, protective helmets usually contain a cap, or external shell, made of rigid and resistant material. Also provided on the front, in correspondence of the eyes, is a wide opening closable by means of a visor that is liftable and made of a transparent material and, in some cases, is also removable.

The so-called integral helmets have, in the inside of the cap a safety padding made from soft material. It is also known that integral helmets, because of their particular structure involve the necessity of being internally ventilated by means of the circulation of an air flow in order to avoid the overheating of the head and/or the formation of condensate due to the perspiration of the user.

In order to provide adequate internal ventilation of the cap, various solutions have been already proposed which are usually based on the principle of capturing air from the outside through openings of various shapes and sizes. These openings are typically placed in the front part of the helmet, above the visor, causing air to circulate between the padding layers by means of canals of various conformations and positions, and then of exhausting it from the helmet back.

A type of integral helmet is also known that includes air intakes in the lower front part. The circulation of air in the inside of the padding and outlet occurs both laterally and at. the top of the cap. In this case, baffles are provided, which are suitable to create a depression capable of drawing warm air from the inside of the helmet and exhausting it towards the outside.

In practice, it has been observed that the known ventilation systems include direct air intakes through openings obtained on the front of the helmet, either by the visor or in the chin protector. These systems usually involve uncomfortable conditions of localized cooling, especially at high speeds, and an insufficient ventilation at low speeds. This is due to the different load losses undergone by the air flow in the canals, the deviation and exhaust openings.

In addition, the internal ventilation devices have the drawback of needing means to activate the opening and closing wings of air intakes. The activators are usually translatable sliders, or the like, emerging from the external surface of the caps. The present systems have drawbacks such as the poor aesthetics and the aerodynamics of the cap, as well as cumbersome cleaning of the same.

SUMMARY OF THE INVENTION

Therefore, it is an object of the present invention to provide an internal ventilation device for helmets for motorcyclists. In particular, for integral helmets, so designed and structured as to be housed in the inside of the helmet cap, substantially disappearing therein. In addition, an internal ventilation combined and adjustable according to need, and conformation such as not to create discontinuities on the external surface of the cap.

Another object of the present invention is to provide an internal ventilation device for helmets that can be easily hooked to the internal surface of the cap and that is highly reliable.

A further object is to provide a ventilation device that is adaptable, in a simple and quick way, to helmets requiring only the direct internal ventilation, i.e., without a system of warm air suction and simultaneous exhaust from the helmet.

These and other objects are achieved by a combined internal ventilation device for helmets for motorcyclists which comprises a first plate-like element, having a substantially polygonal arched form. This first element forms a frontal covering that can be fittingly housed in a corresponding opening in the helmet cap and flush with it.

A second plate-like element, constituting a back covering, which can also be fittingly housed in a corresponding opening in the cap and is located far from said front covering. A bearing plate is anchored under the front covering to define a housing for the kinematic control elements of the ventilation device.

Two air intakes are laterally disposed in the front covering, with respect to an opening located in a central position, and to a further opening designed to house key-means to close the air intakes. The intakes and central opening are closed by wings that can be opened only towards the inside and kept in a closed position through preloaded springs. There is provided a canal that connects the inside of the housing for the control devices to an exhaust opening obtained in the back covering. A wing that can be opened is provided and kept in a closed position by a preloaded spring. The canal forms a duct with the internal surface of the cap. The duct is intended for the suction of warm air from the helmet and for exhausting it towards the outside of the helmet through an exhaust opening.

A sliding plate, with a limited travel, between the front covering and the bearing plate extends in the inside of the duct to allow the activation of the wing closing the exhaust opening of warm air. The sliding plate is provided with means for hooking and unhooking with the end of a positioning lever and a leaf lever so arranged as to allow sequential activation of both the wings of the side intakes and the central. A system of fixed strikers is located between the sliding plate and the front covering and is disposed between the wings of the side inlets and the bearing plate. The positioning lever together with the leaf lever and sliding plate are arranged to allow, by means of a first pressure action on the central wing. The opening of only the two side intake, with return of the central wing to a closing position. A subsequent pressure on the central wing allows stopping in the opening position, the opening of the wing of the warm air exhaust, simultaneous return to a position of total closing of all the wings. This is obtained by a pressure exercised on the key means provided for the closing of all the air intakes. More particularly, the sliding plate is kept pushed towards the back part of the helmet by a preloaded spring placed between the lower bearing plate and the sliding plate.

The positioning lever is centrally hinged on a transversal pin on which also the end of the front central wing is hinged. The positioning lever having an end in contact, through a preloaded spring, with the lower surface of the wing or closing reset key in a closing position. The opposite end being provided with a hook intended for meshing sequentially with two teeth emerging from the sliding plate, in order to realize, by means of subsequent hookings on the teeth, the opening of only the side air intakes, then the opening of the central wing and the simultaneous opening of the warm air exhaust outlet.

The leaf is hinged on the sliding plate so as to undergo a translation at the same time as the translation of the sliding plate only in the opening stage of the side air intakes.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
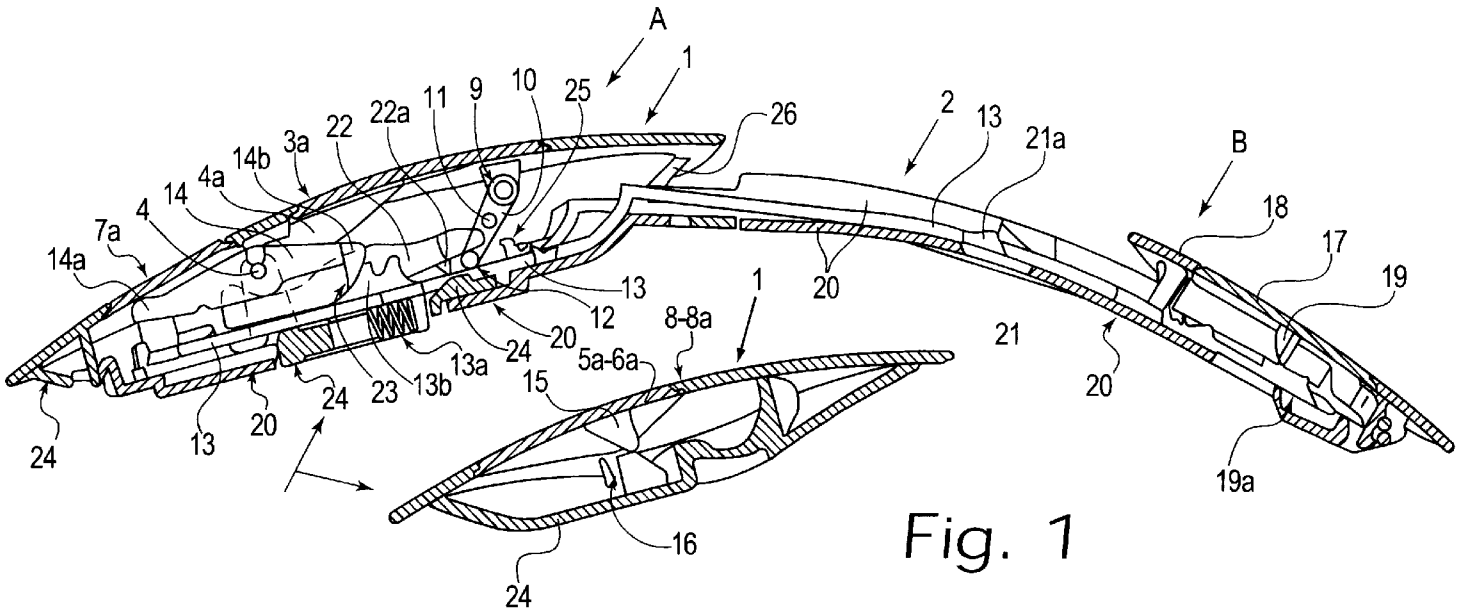
FIGS. 1 and 1*a* show a cross-sectional view and a plan view of the ventilation device la for helmets according to the invention, with the wings arranged in a fully closing position.
Figure 1A:
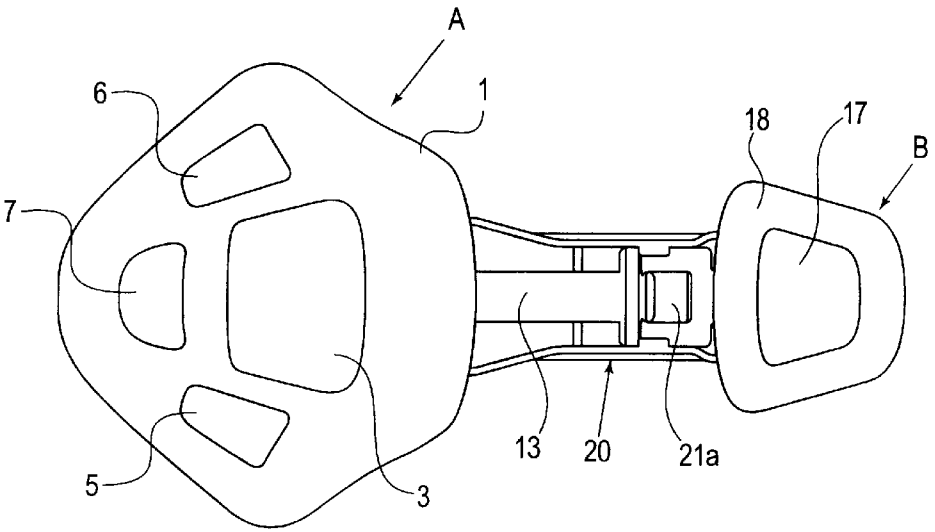

With reference to figures and, in particular, FIGS. 1 and 1*a*, the ventilation device is illustrated in a perfectly closed position and ready to be inserted in the helmet flush with the external surface of the cap.

Figure 7:
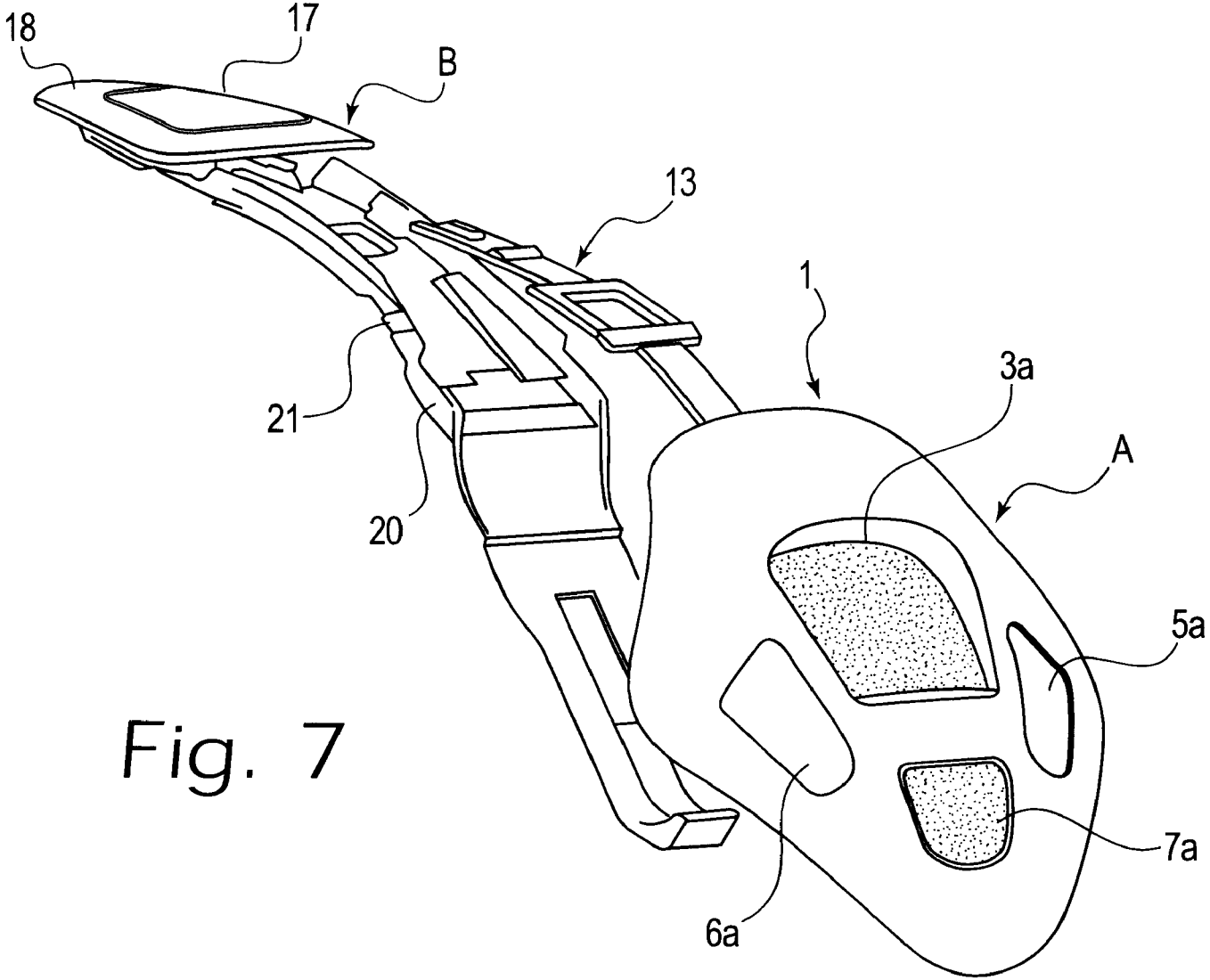
FIG. 7 shows a perspective view of the ventilation device according to the invention, illustrated in two separate parts, i.e., the front covering with central and side air intakes and the sliding plate with the back wing separated from the front covering.

In substance, the ventilation device is realized in two separate parts, as indicated by A and B in FIG. 7, which parts are assembled to each other and then fixed with elastic snap fasteners, screws or like means, to component 21 previously fixed to the cap with rivets or other similar means. The ventilation device contains a plate 1 bent according to the bending radius of the part of cap 2 previously provided with. an opening wherein a front plate or covering 1 is stably inserted so as not to create discontinuities in the external. surface of said cap; front covering 1 of the ventilation device is anchored which results in integration with the cap until it disappears. In the same way, a bearing plate 24 is provided, as a support for the internal gears of part A.

As shown in FIGS. 1 and 1*a*, in front central plate or covering 1 a wide opening 3 is obtained which is closed by a control wing 3*a* (FIG. 1), openable towards the inside of the cap and hinged on a transversal pin 4, through two triangular and parallel flanges 4*a*.

Besides, on the sides of central opening 3 two like openings or intakes 5 and 6 are obtained, closed by a wing 5*a* and respectively, 6*a*, and then an opening 7 closable by a small closing wing or reset key 7*a*; also wings 5*a*–6*a* of side intakes 5–6 can be opened towards the inside of the helmet in correspondence of 8–8*a*. Wings 3*a* and total reset key 7*a* are openable towards the inside and kept in closing position by special preloaded springs, not shown in the figures.

Central wing 3*a* is hinged at 9 to a stem 10 and kept closed by a spring acting between components 3*a* and 10; in its turn, the same central wing is rotatably mounted about pin 4.

Stem 10 has at its free end a roller or cross-bar 12 placed in touch with a sliding plate 13 whose size and function will be explained later on.

Reset key 7*a* is pushed upwards (in closure) by end 14*a* of: a positioning lever 14, which is hinged on pin 4 whereon also central wing 3*a* is hinged, and has at the opposite end a hook 14*b* intended for engaging on teeth 13*b* emerging from sliding plate 13.

Besides, with the device in total closing position, the right and left side wings, 5*a*–6*a*, are kept in closing position by effect of the contact between a conic rib 15, integral with the internal face of the wings and a wedge-shaped element 16 integral with said sliding plate 13; said contact is such as to overcome the springs than tends to open said wings.

The ventilation device also includes, back wing 17 (warm air exhaust) closed against the underlying face of back covering 18 through the contact between a conic rib 19 integral with wing 17 and a wedge-shaped element 19*a* obtained on sliding plate 13.

Sliding plate 13 is translatably mounted in the two directions in the inside of a tunnel-canal 20, which connects, group A to group B (FIG. 7) and realizes with the internal surface of cap 2 a duct having a first converging length and a second diverging length in whose central zone (critical zone) a hole 21 is obtained which, through a hole 21*a* obtained in the sliding plate 13, puts duct 20 in communication with the inside of the helmet.

Sliding plate 13 is opposed to a spring 13*a*, intended for keeping the plate pushed towards the back part of the helmet.

The device, group A, has also a leaf element 22 which, in the starting position as in FIG. 1, is hinged in 23 to sliding plate 13 and results to be superimposed to cross-bar 12 of stem 10 by effect of the contact between rib 22*a* obtained on the lower face of the leaf and an inclined wall obtained on bearing plate 24. This bearing plate forms, together with front covering 1, the zone housing the gears of group A.

Cross-bar 12 of stem 10 is, in its turn, also positionable in contact with a projection 25 obtained on sliding plate 13, as will be better expounded later on.

In FIGS. 1 and 1*a*, the relative position of all the components of the ventilation device object of the present invention, illustrated in the total closing position, is therefore visible.

As concerns the working of the device to pass from the total closing position to the subsequent ones, i.e., opening of the side intakes only, closing of the same, opening of all the air intakes and closing of the same, reference shall be made to FIGS. 2–6.

Figure 2:
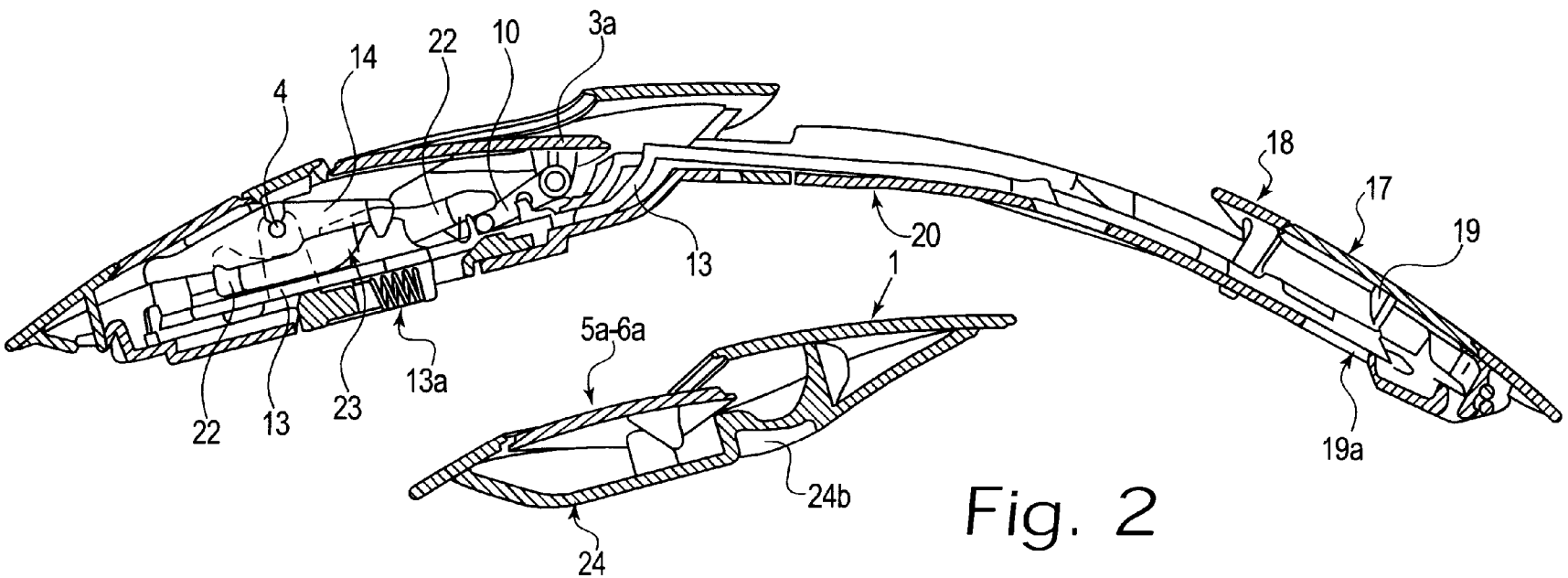
FIG. 2 shows a cross-sectional view of the device of FIG. 1*a*, illustrated with the control central wing in its end of drive position.

In fact, FIG. 2 illustrates the device in the starting opening stage of only the open side intakes 5–6, which stage consists in pressing front central wing 3*a* downwards until it reaches the end of travel point, causing it to rotate about pin 4.

Figure 3:
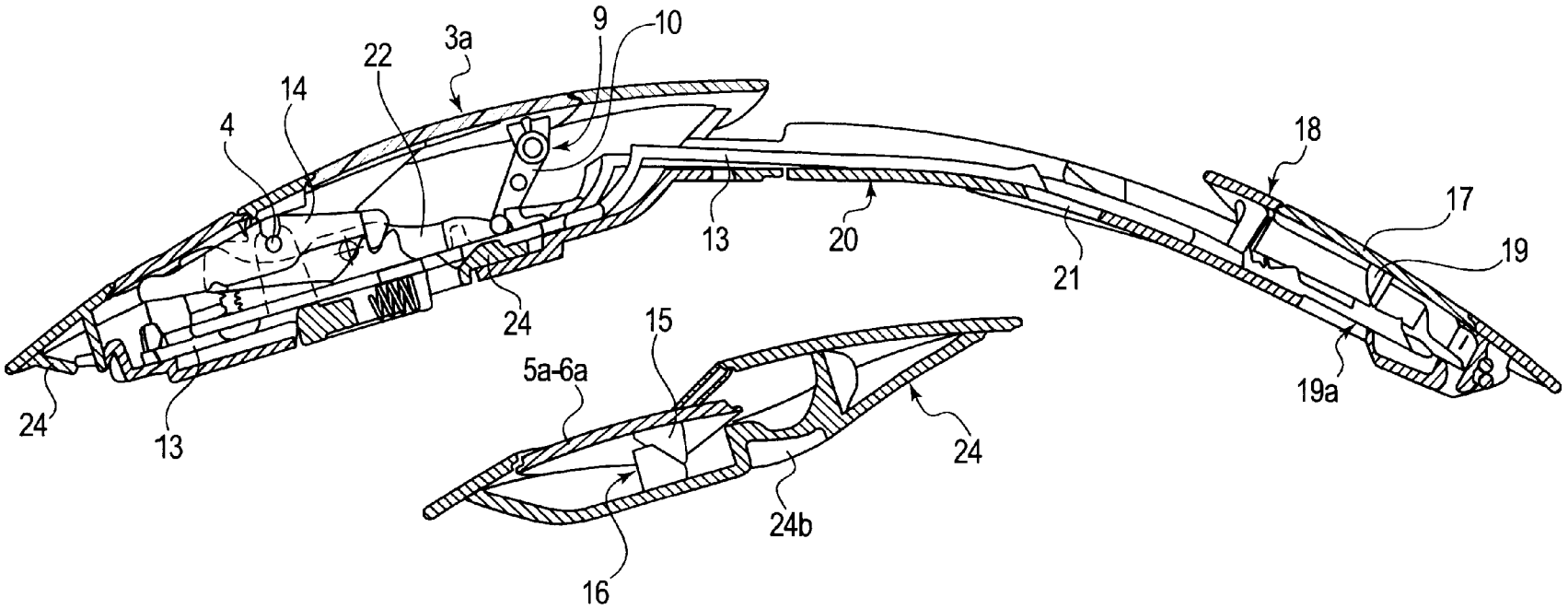
FIG. 3 shows a cross-sectional view of the device of FIG. 1*a*, illustrated with the central wing closed and the side wings open.

In this way, it is possible to overcome the force exercised by the spring of stem 10 and, through cross-bar 12, the force exercised by thrust spring 13*a* on sliding plate 13: as a consequence, the relative angle between wing 3*a* and stem 10 reduces, while the sliding plate translates forwards. At the same time, this latter translation causes the counter-clockwise rotation of the positioning lever 14 about pin 4 by effect of the conic contact existing between lever 14 and teeth 13*b* obtained on sliding plate 13; in such stage, the force exercised by the spring of lever 14 is overcome and there lacks the contact between the later and reset key 7*a*; the coupling between positioning lever 14 and the teeth realizes a ratchet gear and therefore, having surpassed the top of the first tooth, lever 14 slightly rotates clockwise, engaging the first tooth of sliding plate 13. At the same time and by effect of the translation of the sliding plate, also the contact between the side wedges of the latter and the ribs obtained on side wings 5*a* and 6*a* lacks, and consequently, the springs cause respectively wings 5*a* and 6*a* to rotate clockwise, opening the direct side air intakes. The translation of sliding plate 13 has, instead, no influence at all on back wing 17, as the cam realized on the same is so designed as to ensure, in this position, the keeping of the closing position of the wing against back covering 18. During the translation of sliding plate 13 there increases, instead, the width of hole 21 which connects converging-diverging duct 20 with the inside of the helmet. As concerns leaf 22, hinged on the sliding plate, one only observes in this stage that there lacks the contact between rib 22*a* of leaf 22 and the inclined wall of the bearing plate 24; because of the effect of its spring, leaf 22 tends to rotate clockwise, but such rotation is limited by the presence of the cross-bar of stem 10; as a consequence, the leaf undergoes a forwards translation similar to sliding plate 13, remaining superimposed to the cross-bar of stem 10. FIG. 3 shows the relative position of the various components of the ventilation device when only the side intakes 5 and 6 are open; in this case, when pressure is removed from the end of travel position of the front central wing 3*a*, sliding plate 13 cannot return backwards as the force of the thrust spring 13*a* is overcome by the ratchet gear realized by positioning lever 14 with the teeth of the sliding plate 13. Instead, the spring of stem 10 which causes a relative rotation of the latter with respect to the front central wing 3*a* is free to act, determining an increase of the angle between these two components. It ensues that the front central wing rotates counter-clockwise, returning in closing position against front covering 1. The rotation undergone by stem 10 involves the sliding of its cross-bar under leaf 22 and above the sliding plate 13; as these two latter components do not translate, at a given point the cross-bar of steam 10 disengages from the lower wall of leaf 22 which, by effect of its spring, rotates clockwise, striking against the sliding plate. Looking at the position of the cross-bar of stem 10 at the end of such stage, it can be seen that, on the front, it is in touch with the vertical end wall of the leaf and, on the back, it is in touch with a contrasting means obtained on the sliding plate. As concerns side wings 5*a*–6*a*, they are in a lower position and let light into holes 24*b* of bearing plate 24 which couples with channels obtained in the internal padding of the helmet wherein, as a consequence, air can flow from the outside. The reset key 7*a*, the front central wing 3*a* and the back one 17 are, on the contrary, closed.

Figure 4:
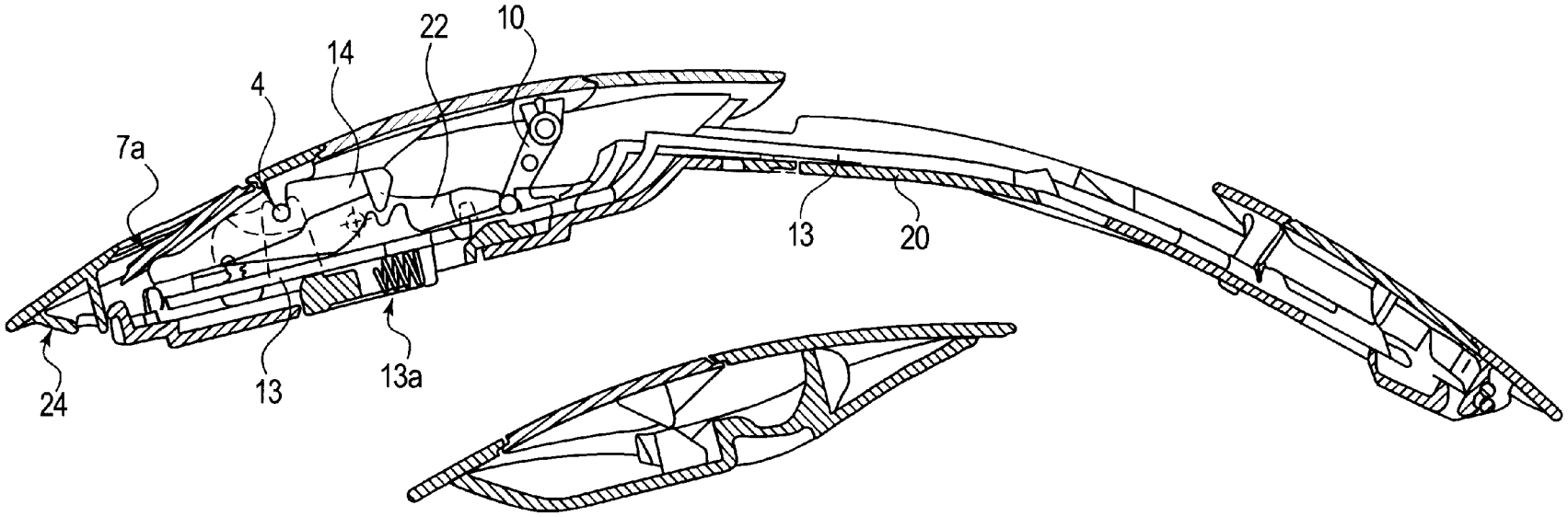
FIG. 4 shows a cross-sectional view of the device of FIG. 1*a* with the only closing return action wing illustrated in a first lowering position.

FIG. 4 shows the device in the closing stage of side air intakes 5 and 6. In fact, it happens that, if from the direct: side ventilation position one wishes to close the system to return to the starting position, it is necessary to strike the reset key 7*a*. There is so obtained a counter-clockwise rotation of reset key 7*a* about pin 4 and, by effect of the contact between the latter and positioning lever 14, the force of its spring is overcome and the counter-clockwise rotation of positioning lever 14 is caused. Lacking the hooking between the positioning lever and teeth 13*b* of the sliding plate, the latter becomes free to translate towards the back of the gear, pushed by the force of thrust spring 13*a*. During this translation of sliding plate 13, also leaf 22 is dragged and, by effect of the conic coupling between its lower rib and the inclined wall obtained on bearing plate 24, it rotates counter-clockwise at the same time, overtaking the cross-bar of stem 10. This rototranslation of leaf 22 is facilitated also by the contact existing between a rib obtained on the lower wall of the reset key 7*a*, and the front end of leaf 22. The front central wing 3*a* remains standstill in closed position, while sliding plate 13 translates sliding under the cross-bar of stem 10. The same holds good for back wing 17, whose lower rib 19 slides on sliding plate 13. On the contrary, side wings 5*a*–6*a* are closed by effect of the conic couplings realized by their ribs 15 against side wedges 16 of sliding plate 13.

Figure 5:
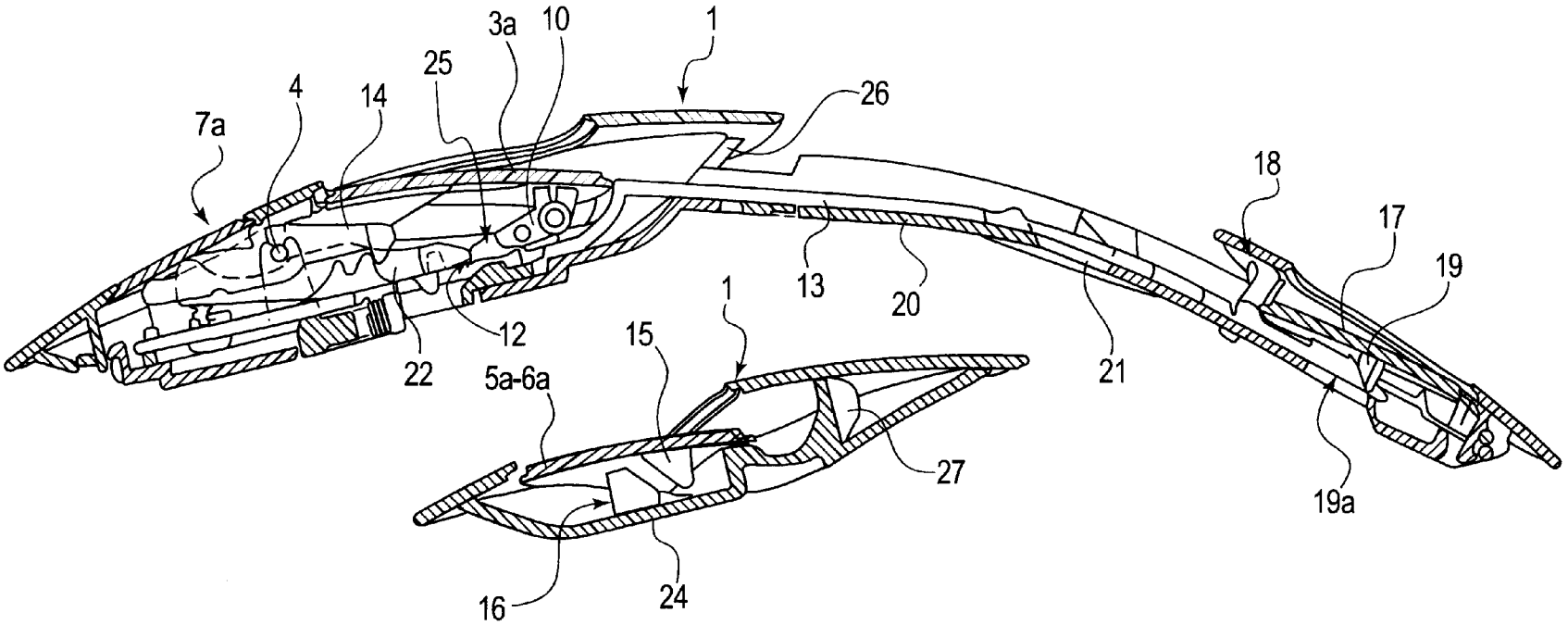
FIG. 5 shows the device of FIG. 1 with all the wings of air intake in opening position, i.e., facing the inside.

FIG. 5 shows the operating stage to pass from the position wherein only side intakes 5–6 are open to the all-open position. In fact, starting from the position of FIG. 4, if one presses front central wing 3*a* downwards up to the end, of travel point, said wing rotates about pin 4. In this way there is overcome the force exercised by the spring of stem 10; by cross-bar 12 obtained on the latter, which is in touch with the back vertical wall of leaf 22, also the force exercised by thrust spring 13*a* on sliding plate 13 is overcome. As a consequence, the relative angle between wing 3*a* and stem 10 reduces, while sliding plate 13 translates forwards. At the same time, this latter translation causes the counter-clockwise rotation of positioning lever 14 about pin 4 by effect of the conic contact existing between lever 14 and the teeth obtained on sliding plate 13; in this stage, the force exercised by the spring of lever 14 is overcome and the contact between the latter and the reset key 7*a* is lacking; having overcome the top of the second tooth of the ratchet gear, lever 14 slightly rotates clockwise, stopping against the side of the second tooth of sliding plate 13. At the same time and by effect of the translation of the sliding plate, side wings 5*a*–6*a* undergo a further clockwise rotation, lowering by effect of the respective springs and further opening the direct side air intakes. Leaf 22, hinged on sliding plate 13, during such stage undergoes only the forwards translation integrally with that undergone by the sliding plate. During the translation of sliding plate 13, the width of hole 21 connecting the converging-diverging duct with the inside of the helmet increases further. As concerns the back group of the mechanism, the translation of sliding plate 13 causes in this case the opening of back wing 17 by effect of the inclination of the conic cam that couples with rib 19 obtained on the lower surface of the latter. Always with reference to FIG. 5, wherein only the reset key 7*a* remains closed while all the other wings are open, to better clarify the positions taken on by the various components of the device in a position of total opening, it ensues that when from the end of travel position of central front wing 3*a* the pressure is eliminated, sliding plate 13 cannot go back as the strength of the thrust spring 13*a* is overcome by the ratchet gear realized by the positioning lever 14 with the teeth of sliding plate 13. Also the spring of stem 10 cannot substantially act by effect of the contrasting means existing on the locked sliding plate 13, which couples with the back part of cross-bar 12 of stem 10. As a consequence, after a short relative rotation between stem 10 central front wing 3*a* by which the clearances of the mechanism are made up for, the central front wing remains locked in a lower position, lighting the converging-diverging duct realized by tunnel 20.

Looking at the position of cross-bar 12 of stem 10, at the end of such stage it is possible to observe that in the front part it is in touch with the vertical end wall of leaf 22, while in the back part it is in touch with a contrasting means 25 obtained on sliding plate 13. Even though a spring tends to cause stem 10 to return to a vertical position, this is prevented by the contrasting means obtained on sliding plate 13. Back wing 17 remains open, allowing the discharge towards the outside of the air coming from the converging-diverging duct 20; from the latter the air goes out that had entered through the front opening 26 opened by the front central wing 3*a* plus the air extracted in the inside of the helmet which passes first through a suitable channel in the internal padding then into hole 21 obtained in the central part of tunnel 20 and lastly in the opening opened by hole 21*a* of the sliding plate 13. As concerns side wings 5*a*–6*a*, they remain in lower position, lighting the holes obtained on bearing plate 24 that couple with channels obtained on the internal padding of the helmet, wherein air can therefore flow from the outside. Reset key 7*a* is, instead, closed.

Figure 6:
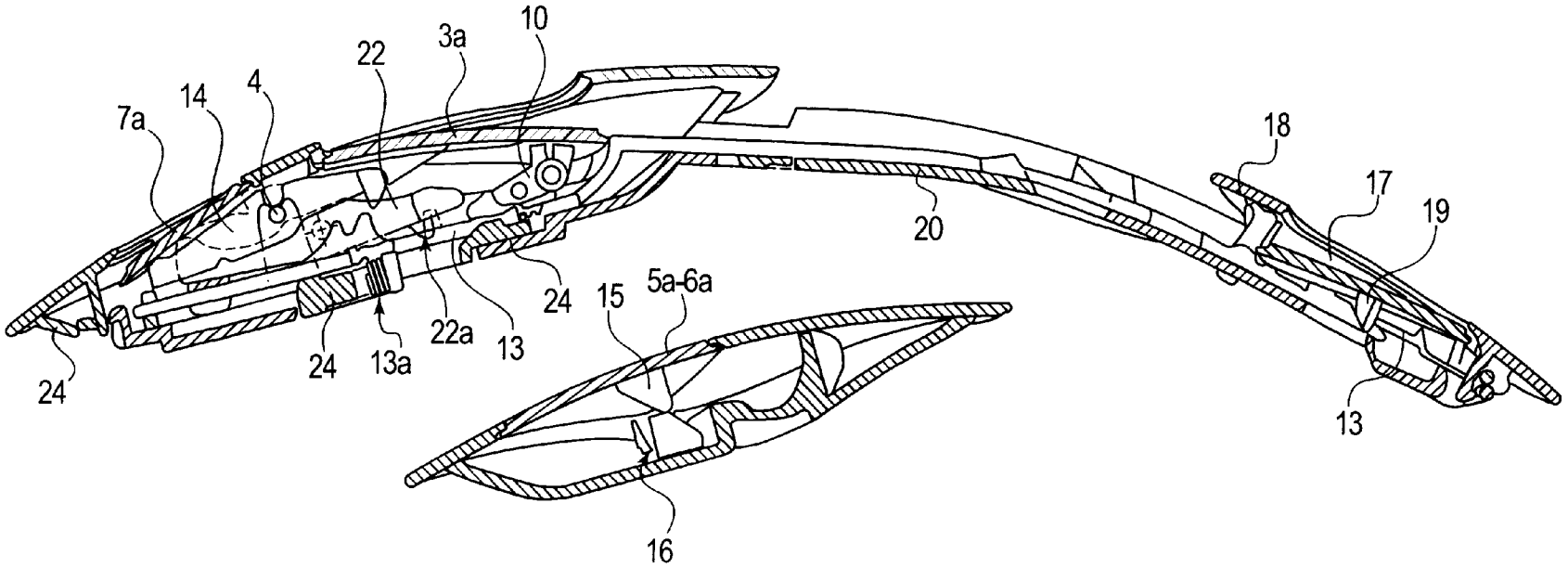
FIG. 6 shows the device of FIG. 1 with the closing return action wing illustrated in a second return position.

FIG. 6 stresses the sequence of the positions of the components in the closing stage of the device. In fact, if from the ventilation position of FIG. 5 one wishes to close the system to return to the starting position, it is necessary to strike reset key 7*a*. An counter-clockwise rotation of reset. key 7*a* about pin 4 is obtained and, by effect of the contact of the latter and positioning lever 14, the strength of a spring is overcome and the counter-clockwise rotation of the positioning lever is caused. Failing the hooking between positioning lever 14 and the teeth of sliding plate 13, the latter is free to translate towards the back part of the mechanism, pushed by the strength of thrust spring 13*a*. During this translation of sliding plate 13, also leaf 22 is dragged and, by effect of the conic coupling between its lower rib 22*a* and the inclined wall obtained on bearing plate 24, it rotates simultaneously in counter-clockwise direction overcoming the cross-bar of stem 10. This rototranslation of leaf 22 is eased also by the contact existing between a rib obtained on the lower wall of reset key 7*a* and the front end of leaf 22. Through the contrasting means realized by cross-bar 12 of stem 10, central front wing 3*a* is pushed until it closes. At the same time, back wing 17 whose lower rib slides on sliding plate 13, is brought back to the closing position against back covering 18. Side wings 5*a*–6*a* are closed again by effect of the conic couplings realized by their ribs against the side wedges 16 of sliding plate 13.

Therefore, the simple activation of reset key 7*a* causes the positions of FIG. 6 to return to the position of FIG. 1, i.e., to the conditions of a fully closed ventilation device.

FIG. 7 shows a perspective view of the device of the present invention, which is illustrated according to two separate parts, i.e., from the front part A separated by the back part B, to better stress especially the duct containing sliding plate 13.

Accordingly, while only a few embodiments of the present invention have been shown and described, it is obvious that many changes and modifications may be made thereunto without departing from the spirit and scope of the invention.

What is claimed is:

1. A combined internal ventilation device for helmets for motorcyclists comprising:

a first plate-like element, having a substantially polygonal arched form, forming a front covering (1) that can be fittingly housed in a corresponding opening of a helmet cap (2) and flush with it;

a second plate-like element, forming a back covering (18), that can also be fittingly housed in a corresponding opening of cap (2) and far from said front covering (1);

a bearing plate (24) anchored under said front covering (1) and at a short distance from this, in order to define a housing for kinematic control elements of the ventilation device;

two air intakes (5, 6), obtained in said frontal covering (1), laterally with respect to an opening (3) located in central position, and to a further opening (7) designed to house key-means (7*a*) for the closing activation of all the air intakes (3, 5, 6), said air intakes (5, 6), and a central air intake (3) and said further opening (7) being closed by wings (5*a*, 6*a*, 3*a*) that can be opened only towards the inside and kept in closing position through suitably preloaded springs;

a canal (20) connecting the inside of said housing for the kinematic control elements with an exhaust opening obtained in said back covering (18) and provided with an additional wing (17) that can be opened and kept in a closed position by a preloaded spring, said canal (20) forming a duct with the internal surface of the cap (2), said duct being intended for the suction of warm air from the helmet and for exhausting it towards the outside of said helmet through said exhaust opening; and a plate (13) sliding, with a limited travel, between said front covering (1) and said bearing plate (24) extended in the inside of said duct to allow the activation of said additional wing (17) closing the exhaust opening of warm air, said sliding plate (13) being provided with means for hooking and unhooking (10–12) with the end of a positioning lever (14) and a leaf lever (22) so arranged as to allow sequential activation of two of said wings (5*a*, 6*a*) of the air intakes, and a third wing (3*a*) and the key-means (7*a*) of all wings, between said sliding plate (13) and said front covering (1) there being also provided a system of fixed strikers (15, 16) located between the wings (5*a*, 6*a*) of the air intakes and said bearing plate (24), said positioning lever (14) together with said leaf and said sliding plate being so arranged as to allow, by a first pressure action on said third wing (3*a*), the opening of the two side intakes (5, 6), with return of the third wing (3*a*) to a closing position and, by means of a second pressure on said third wing (3*a*), up to allow its stopping in an open position, also the opening of the additional wing (17) of the warm air exhaust, the simultaneous return to a position of total closing of all the wings being obtained by a pressure exercised on said key means (7*a*) provided for the closing of all the air intakes.

2. The ventilation device according to claim 1, characterised in that said sliding plate (13) is kept in position by a preloaded spring (13*a*) placed between said sliding plate (13) and said bearing plate (24).

3. The ventilation device according to claim 1, characterised in that said positioning lever (14) is centrally hinged on a pin (4) transversal relatively to the sliding direction of said sliding plate, and also an end of said front central wing (3*a*) is hinged on the same transversal pin (4).

4. The ventilation device according to claim 1, characterised in that said positioning lever (14) has an end in touch, through a preloaded spring, with the lower surface of said key-means (7*a*) resetting in closing position all the wings, and the other end provided with a hook (14*b*) intended for meshing sequentially with two teeth (13*b*) emerging from said sliding plate (13), in order to realise, by means of two subsequent hookings on said teeth (13*b*), first the opening of only the side air intakes (5, 6), then the opening of said front central wing (3*a*) and simultaneously with the opening of said front central wing (3*a*) also, the opening of the wing (17) for the warm air exhaust outlet or opening towards the outside of the helmet.

5. The ventilation device according to claim 4, characterised in that said leaf lever or rocking lever (22) is hinged on the sliding plate (13) before the two teeth **(13*b*) emerging from the latter, and is intended for translating simultaneously to the translation of the sliding plate (13) only during the opening stage of said side air intakes (5, 6)**.

6. The ventilation device according to claims 1 and 5, characterized in that to said front wing **(3*a*) an oscillating stem (10) is hinged, provided with a preloaded spring for keeping the wing in closing position, and, at the free end, with a cross-bar (12) placed in touch with said sliding plate (13) and in touch with a rib (24) emerging from said leaf lever (22), said leaf lever (22) being subjected to a rototranslation movement, overcoming said cross-bar (12), only in the closing stage of said side air intakes (5, 6)**.

7. The device according to claim 1, characterised in that on said bearing plate (24), openings are provided in correspondence of the side air intakes (5, 6) and communicating with channels obtained in helmet padding.

* * * * *